United States Patent [19]

Ford et al.

[11] 4,028,214

[45] June 7, 1977

[54] ADJUSTABLE ELECTRODE

[75] Inventors: James M. Ford, Cleveland, Tenn.; Elmer N. Macken, Baltimore, Md.

[73] Assignee: Olin Corporation, New Haven, Conn.

[22] Filed: Jan. 28, 1976

[21] Appl. No.: 653,144

[52] U.S. Cl. ..... 204/286; 204/252; 204/288

[51] Int. Cl.[2] ..... C25B 9/02; C25B 1/03

[58] Field of Search ..... 204/286, 288, 263, 225, 204/252

[56] References Cited

UNITED STATES PATENTS

| | | | |
|---|---|---|---|
| 3,674,676 | 7/1972 | Fogelman | 204/286 |
| 3,803,016 | 4/1974 | Conner, Jr. | 204/286 |
| 3,932,261 | 1/1976 | Kircher | 204/286 |
| 3,941,676 | 3/1976 | Macken | 204/286 |

*Primary Examiner*—T. M. Tufariello

*Attorney, Agent, or Firm*—James B. Haglind; Donald F. Clements; Thomas P. O'Day

[57] ABSTRACT

An adjustable electrode for use in electrolytic cells is provided. The electrode comprises two rectangular electrode surfaces positioned in parallel and having a space between them. Two electrode posts are located in this space and have resilient conductive means to attach one electrode post to one electrode surface. Contractible means are attached along two non-adjacent edges of the electrode surfaces positioned outside of the space between the electrode surfaces. Clamping means are attached to the contractible means to vary the space between the electrode surfaces.

The adjustable electrode, employed for example in the electrolysis of alkali metal chlorides, has adjusting means which are readily accessible and where the inter-electrode spacing can be conveniently changed.

8 Claims, 4 Drawing Figures

ADJUSTABLE ELECTRODE

The invention relates to electrolytic cells for the electrolysis of aqueous salt solutions. More particularly, this invention relates to adjustable electrodes employed in electrolytic cells for the electrolysis of aqueous alkali metal chloride solutions.

It is known to employ adjustable electrodes in, for example, diaphragm-type electrolytic cells, as illustrated by U.S. Pat. No. 3,674,676, issued July 4, 1972, to E.I. Fogelman. In this patent, expandable electrodes are employed in a cell having a riser attached to the bottom or base of the cell and extending upwards. Current is supplied to the electrodes through the riser by attaching two movable electrically conducting members to opposite sides of the riser and to the electrode surfaces. The movable members are positioned in the space between the electrode surfaces. To change the electrode space, each of the members must be adjusted separately by manually carrying out the required manipulations within the space between the electrode surfaces. The means of adjustment are therefore not readily accessible. In addition, the placement of the adjustable means within the space between the electrode surfaces makes assembly and disassembly of the electrodes more difficult.

It is further known, as described in the U.S. Pat. No. 3,941,676 issued March 2, 1976, to E.N. Macken to employ a rotary shaft having means of attachment to each of two electrode surfaces. Positioned in parallel, the electrode surfaces have a space between them. The rotary shaft may be positioned either in this space or outside of it. Rotation of the shaft varies the spacing between electrode surfaces. Considerable expense is required, however, in fabricating and attaching the apparatus to the electrode surfaces.

An improved adjustable electrode is therefore required where the inter-electrode spacing can be readily and conveniently changed.

It is an object of the present invention to provide a novel adjustable electrode useful in electrolytic cells for the production of chlorine and oxychlorine compounds.

An additional object of this invention is to provide a novel adjustable electrode useful in electrolytic cells employing metal electrodes.

Another object of the present invention is to provide a novel adjustable electrode where the adjustable elements are independent of those elements supplying current to the electrodes.

These and other objects of the present invention are accomplished in an adjustable electrode suitable for use in a cell for the electrolysis of alkali metal chlorides which comprises:

a. two rectangular electrode surfaces positioned in parallel and having a space between the electrode surfaces,
b. at least two electrode posts positioned in the space between the electrodes surfaces,
c. at least two resilient electrically conductive means, each of the resilient conductive means being attached to only one of the electrode posts, and only one of the electrode surfaces,
d. contractible means having means for attachment along two non-adjacent edges of each of the electrode surfaces, the contractible means being positioned outside of the space between the electrode surfaces, and
e. removable clamping means adapted to contact said contractible means.

Accompanying FIGS. 1–4 illustrate the novel adjustable electrodes of the present invention. Corresponding parts have the same numbers in all FIGS.

FIG. 4 shows an embodiment of the clamping means of the present invention.

Figure 1:
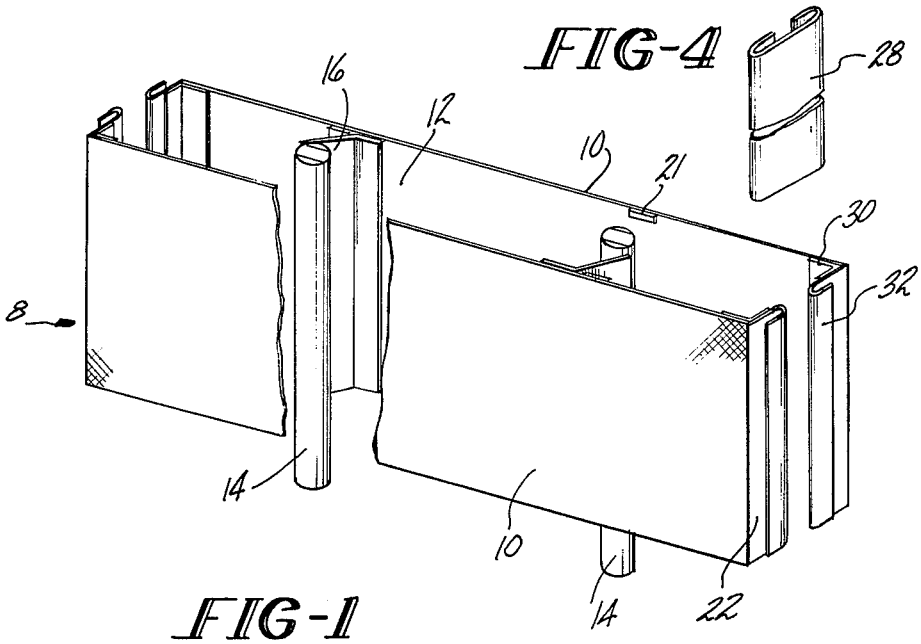
FIG. 1 illustrates a perspective view with portions removed of an adjustable electrode of the present invention.

Electrode 8 in FIG. 1 is comprised of electrode surfaces 10 positioned in parallel and having space 12 between them. Electrode posts 14 are positioned within space 12 being linearly arranged and equally spaced apart from electrode surfaces 10. Resilient electrically conducting sheets 16 are each attached to one of the electrode posts 14 and to one of the electrode surfaces 10. Strips 22 are attached along one enge of L-shaped supports 30. The other edges of L-shaped supports 30 is attached to the inner side of electrode surfaces 10. Lips 32 on strips 22 provide means of attachment for clamps 28.

Figure 2:
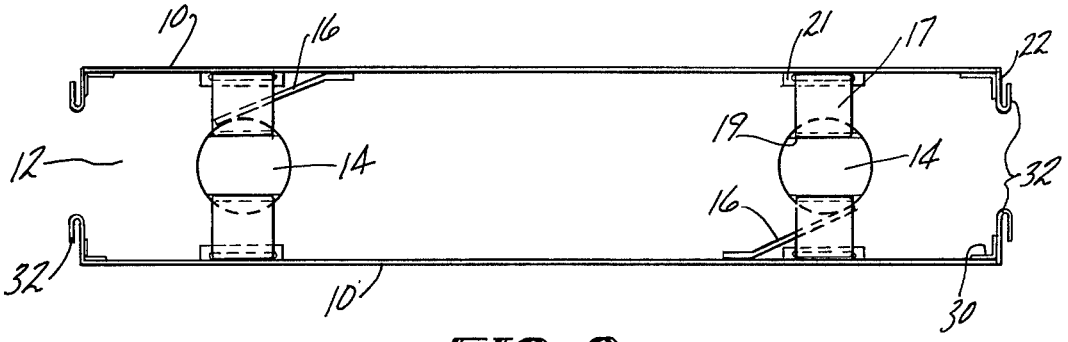
FIG. 2 represents a top view of the adjustable electrode of FIG. 1 in expanded form.

FIG. 2 represents a top view of the electrode of FIG. 1 where electrode 8 is in an expanded mode to position the electrode surfaces as they would be used during the operation of an electrolytic cell. To maintain the electrode surfaces 10 parallel to each other and to electrode posts 14 when electrode 8 is in the expanded mode, U-shaped clips 17 are employed. One end of U-shaped clips 17 is inserted in grooves 19 in the top of electrode posts 14, the other end of U-shaped clips 17 is inserted in slot 21 along the inner edges of electrode surfaces 10. U-shaped clips 17 are removed prior to positioning electrode 8 in a contracted mode.

Figure 3:
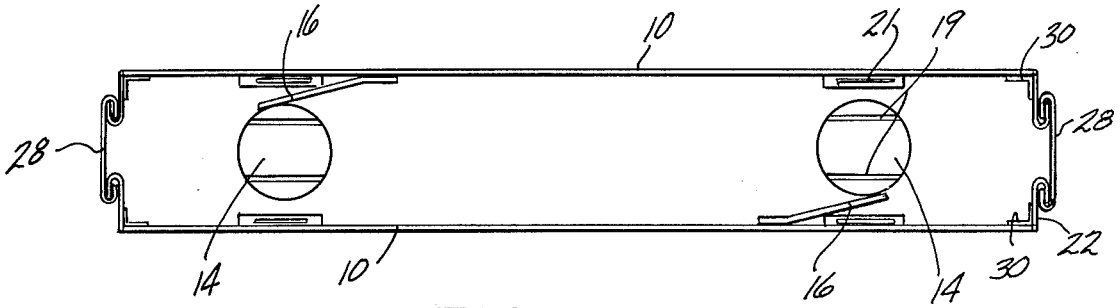
FIG. 3 depicts a top view of the adjustable electode of FIG. 1 in contracted form.

In FIG. 3, drive clamps 28, as shown in FIG. 4, are attached to lips 32 on strips 22 to contract resilient electrically conducting sheets 16 and move elec- trode surfaces 10 toward electrode posts 14. The con- tracted form of the electrode is employed when the electrodes in the cell are being assembled or disassembled.

The electrode of the present invention is secured to a cell base or side wall having means of supplying electric current to the electrode where the electrode serves as an anode, or having means of removing current from the electrode where it serves as a cathode. Preferably the electrode is used as an anode in a cell for the electrolysis of alkali metal chloride to produce chlorine and an alkali metal hydroxide or an alkali metal chlorate, however, other uses of the electrode of the present invention will be discerned by those skilled in the art.

Two rectangular electrode surfaces are positioned in parallel and have a space between them. Normally, the electrode surfaces will be positioned vertically. The space can be any suitable distance, for example, from about 15 to about 50 millimeters. Positioned in this space are two or more electrode posts which are spaced apart from each of the electrode surfaces, preferably by an equal distance. The number of electrode posts used is not critical and is generally related to the width of the electrode surface. Any suitable number such as from 2 to about 10 electrode posts may be used. To provide electrical contact between the electrode posts and the electrode surfaces, a resilient electrically conducting connecting member is attached to only one of the electrode posts and only one of the electrode surfaces. This connecting member is a flexible sheet or band which preferably is attached along the full length of the electrode post. The materials of conducting connecting member are chosen to provide the desired electrical conductivity suitable for the cell environment. In addition, sufficient resiliency should be available to permit the connecting member to be held in the closed position during assembly and disassembly of the cell and to return to its original or another position when the holding forces are removed or changed. Suitable materials of construction include valve metals such as titanium where the electrode is an anode or metal such as steel, nickel, copper, or copper alloys, where the electrode is a cathode.

To provide the means of adjustment for the electrode of the present invention, contractible means are attached along two non-adjacent edges of each electrode surface. The edges may be the side edges or the top edge and bottom edge of each of the electrode surfaces. The con- tractible means may be, for example, a band or strip. Where the contractible means are to be positioned along an edge of the electrode through which the flow of fluids is desired, suitable openings in the contractible means may be provided or the contractible means may be comprised of a pair of strips. Attachment means for the contractible means include, for example, L-shaped members attached along the inner sides of the electrode surfaces, as illustrated in FIG. 1. Other suitable attachment means include providing a groove or slot along the edge of the electrode surface in which a tab on the edge of the contractible means may be inserted. Additional suitable means of attachment include the use of suitable adhesives, clips, welds, and the like. The contractible means have lips, flanges or other suitable means to which the removable clamping means are attached.

Any suitable clamps or clips may be used as the clamping means which will provide the force necessary to contract the contractible means, the resilient electrically conducting members, and thus the electrode surfaces the desired distance. During contraction or expansion, the electrode surfaces remain parallel to each other.

Any suitable materials of construction may be used for the contractible means and the clamping means which are resistant to the gases and liquids found in the ele- trolytic cell. Where the cell is used for electrolysis of sodium chloride, the clamping means may be composed of electrically conducting metals such as titanium or tantalum, or their alloys where the electrode serves as an anode; steel, nickel, copper, or their alloys where the electrode serves as a cathode. It may be economically advantageous to use non-conducting materials such as hard rubber, micarta, and plastic materials such as polytetrafluoroethylene, polyvinylidene chloride, polyester resins, polyvinyl chloride, and post-chlorinated polyvinyl chloride. Preferred nonconducting materials of construction for the clamping means include hard rubber and polytetrafluoroethylene.

To retain the electrode surfaces in a parallel position when the electrode is in the expanded form, it may be desirable to position the electrode surfaces a fixed distance from their respective electrode posts. This can be done, for example, by providing a positioning means between the electrode posts and the electrode surface. One suitable positioning means is a U-shaped pin or clip. One end of the clip is inserted in the opening in the top of the electrode post; the other end is inserted in an opening in its resilient electrically conductive means. The clip maintains the space between the electrode posts and the electrode surface at the desired distance and holds the electrode surfaces in a substantially parallel position with respect to each other. Another suitable positioning means is an eccentric washer which is attached to the upper and lower parts of the electrode posts. When the washer is turned, contact is made with the electrode surface, and the electrode surface is retained in the de- sired position. The positioning means are removed prior to contracting the electrode surfaces with the clamping means.

The adjustable electrode of the present invention is suitable for use in diaphram-type electrolytic cells for the electrolysis of alkali metal chloride solutions such as sodium chloride. The adjustable electrode may be attached to a cell base or bottom, side wall or to the top or cover of the cell. Any suitably known means of attachment such as bolting or the like may be used to position the electrodes.

The electrode surfaces used are preferably those of metal. Where the electrode surface serves as the anode, a foraminous metal which is a good electrical conductor may be used. It is perferred to employ a valve metal, such as titanium or tantalum or a metal, for example, steel, copper, or aluminum clad with a valve metal such as tantalum or titanium. The valve metal has a thin coating over at least part of its surface of a platinum group metal, platinum group metal oxide, an alloy of a platinum group metal or a mixture thereof. The term "platinum group metal" as used in the specification, means an element of the group consisting of ruthenium, rhodium, palladium, osmium, iridium, and platinum.

The anode surfaces may be in various forms, such as an expanded mesh which is flattened or unflattened, and having slits horizontally, vertically or angularly. Other suitable forms include woven wire cloth, which is flattened or unflattened, bars, wires, or strips arranged, for example, vertically, and sheets or plates having perforations, slits, or louvered openings.

A preferred anode surface is a foraminous metal mesh having good electrical conductivity in the vertical direction.

As the cathode, the electrode surface is suitably a metal screen or mesh where the metal is, for example iron, steel, nickel, or tantalum.

The adjustable electrode of the present invention is readily installed and disassembled. Where the electrode surface needs to be removed, for example, for recoating of the electrochemically active area, the post and the resilient electrically conductive means are accessible for disconnec- tion. Adjustment of the inter-electrode space can be done from outside the electrode surfaces without having to gain access to the space between the electrode surfaces. Both the contractible means and the clamping means may be fabricated from inexpensive materials of construction.

What is claimed is:

1. An electrode suitable for use in a cell for the electrolysis of alkali metal chloride solutions which comprises:

a. two rectangular electrode surfaces positioned in parallel and having a space between said electrode surfaces, b. at least two electrode posts positioned in said space between said electrode surfaces, c. at least two resilient electrically conductive means each of said resilient electrically conductive means being attached to only one of said electrode posts and to only one of said electrode surfaces, d. contractible means having means for attach- ment along two non-adjacent edges of each of said electrode surfaces, said contractible means being positioned outside of said space between said electrode surfaces, and e. removable clamping means adapted to contact said contractible means.

2. The electrode assembly of claim 1 in which said contractible means is composed of an electrically non-conducting plastic material selected from the group consisting of polytetrafluoroethylene, polyvinylidene chloride, poly- vinyl chloride, and post-chlorinated polyvinyl chloride.

3. The electrode assembly of claim 1 in which said contractible means is composed of a metal selected from the group consisting of titanium, tantalum, steel, nickel, copper, and alloys thereof.

4. The electrode assembly of claim 1 in which said electrode posts are spaced apart an equal distance from each of said electrode surfaces.

5. The electrode assembly of claim 1 in which said contractible means is attached along the side edges of each of said electrode surfaces.

6. The electrode of claim 1 in which said electrode posts have an opening in the top of said electrode posts and an opening along the inner edge of said electrode surfaces and a positioning means inserted in said openings.

7. The electrode of claim 1 in which said positioning means is a U-shaped clip or pin.

8. An anode assembly suitable for use in a cell for the electrolysis of alkali metal chloride solutions which comprises:

a. two rectangular electrode surfaces positioned in parallel and having a space between said electrode surfaces, b. two electrode posts positioned in said space between said electrode surfaces, c. two resilient electrically conductive means, each of resilient conductive means being attached to only one of said electrode posts and to only one of said electrode surfaces, d. contractible means having means for attachment along two non-adjacent edges of each of said electrode surfaces, said contractible means being positioned outside of said space between said electrode surfaces, and e. removable clamping means adapted to contact said contractible means.

* * * * *

UNITED STATES PATENT OFFICE

CERTIFICATE OF CORRECTION

Patent No. 4,028,214 Dated June 7, 1977

Inventor(s) James M. Ford and Elmer N. Macken

It is certified that error appears in the above-identified patent and that said Letters Patent are hereby corrected as shown below:

Column 2, line 26, delete "enge" and insert --edge--.

Column 2, line 27, delete "edges" and insert --edge--.

Column 2, line 45, delete "elec- trode" and insert --electrode--.

Column 2, line 46, delete "con- tracted" and insert --contracted--.

Column 3, line 11, after "of" insert --construction of the resilient electrically--.

Column 3, line 28, delete "con- tractible" and insert --contractible--.

Column 3, line 56, delete "ele- trolytic" and insert --electrolytic--.

Column 4, line 19, delete "de- sired" and insert --desired--.

Column 4, line 62, delete "disconnec- tion" and insert --disconnection--.

UNITED STATES PATENT OFFICE

CERTIFICATE OF CORRECTION

Patent No. 4,028,214 Dated June 7, 1977

Inventor(s) James M. Ford and Elmer N. Macken

It is certified that error appears in the above-identified patent and that said Letters Patent are hereby corrected as shown below:

Claim 1, section d., Column 5, line 15, delete "attach- ment" and insert --attachment--.

Claim 2, Column 5, line 27, delete "poly- vinyl" and insert --polyvinyl--.

Claim 7, Column 6, line 12, delete "1" and insert --6--.

Claim 8, section c., Column 6, line 22, after "of" insert --said--.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*